US009275805B2

(12) United States Patent
Bunk et al.

(10) Patent No.: US 9,275,805 B2
(45) Date of Patent: Mar. 1, 2016

(54) SWITCHING UNIT FOR AN ELECTRICAL SWITCHING DEVICE

(71) Applicants: Thomas Bunk, Sulzbach-Rosenberg (DE); Andreas Hierl, Schmidgaden (DE); Bernhard Mayer, Mitterteich (DE); Siegfried Pirker, Ensdorf (DE); Christian Pohle, Nöbdenitz (DE)

(72) Inventors: Thomas Bunk, Sulzbach-Rosenberg (DE); Andreas Hierl, Schmidgaden (DE); Bernhard Mayer, Mitterteich (DE); Siegfried Pirker, Ensdorf (DE); Christian Pohle, Nöbdenitz (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 231 days.

(21) Appl. No.: 13/707,830

(22) Filed: Dec. 7, 2012

(65) Prior Publication Data

US 2013/0206558 A1 Aug. 15, 2013

(30) Foreign Application Priority Data

Feb. 9, 2012 (DE) ..... 10 2012 201 939

(51) Int. Cl.

| | |
|---|---|
| ***H01H 3/04*** | (2006.01) |
| ***H01H 3/20*** | (2006.01) |
| ***H01H 3/46*** | (2006.01) |
| ***H01H 71/52*** | (2006.01) |
| ***H01H 73/04*** | (2006.01) |
| *H01H 1/20* | (2006.01) |

(52) U.S. Cl.

CPC . *H01H 3/04* (2013.01); *H01H 3/46* (2013.01); *H01H 71/52* (2013.01); *H01H 73/045* (2013.01); *H01H 1/2058* (2013.01)

(58) Field of Classification Search

CPC ..... H01H 1/2058; H01H 3/04; H01H 3/46; H01H 3/52; H01H 3/54; H01H 71/52; H01H 71/505; H01H 73/045

USPC ..... 200/335, 400, 401

See application file for complete search history.

(56) References Cited

U.S. PATENT DOCUMENTS

| | | | | |
|---|---|---|---|---|
| 4,128,750 | A * | 12/1978 | Castonguay et al. | 200/308 |
| 4,951,019 | A * | 8/1990 | Gula | 335/166 |
| 6,087,913 | A * | 7/2000 | Castonguay et al. | 335/16 |
| 2009/0065341 | A1* | 3/2009 | Shmukler et al. | 200/400 |
| 2010/0193339 | A1* | 8/2010 | Godesa | 200/335 |
| 2012/0199453 | A1 | 8/2012 | Hierl et al. | |

FOREIGN PATENT DOCUMENTS

| | | | |
|---|---|---|---|
| DE | 69930221 | T2 | 11/2006 |
| DE | 102009050296 | A1 | 4/2011 |
| WO | WO 2012117271 | A1 | 9/2012 |

OTHER PUBLICATIONS

Mexican Office Action dated Nov. 18, 2014 for corresponding Mexican Application No. MX/2014/96981.

* cited by examiner

*Primary Examiner* — Renee Luebke
*Assistant Examiner* — Lheiren Mae A Caroc
(74) *Attorney, Agent, or Firm* — Harness, Dickey & Pierce, P.L.C.

(57) ABSTRACT

A switching unit for an electrical switching device, in particular an electrical circuit breaker, is disclosed. The switching unit includes a switching lock with a switching mechanism and a rotor housing with a contact arm disposed therein for opening and closing contacts during a rotation of the rotor housing about a rotation axis. In an embodiment, at least one lever apparatus is functionally connected at its upper end by way of the switching mechanism and at its lower end by way of a connecting pin to a face of the rotor housing.

16 Claims, 3 Drawing Sheets

SWITCHING UNIT FOR AN ELECTRICAL SWITCHING DEVICE

PRIORITY STATEMENT

The present application hereby claims priority under 35 U.S.C. §119 to German patent application number DE 10 2012 201 939.1 filed Feb. 9, 2012, the entire contents of which are hereby incorporated herein by reference.

FIELD

At least one embodiment of the present invention generally relates to a switching unit for an electrical switching device, in particular an electrical circuit breaker. At least one embodiment of the present invention also generally relates to an electrical switching device, in particular an electrical circuit breaker.

BACKGROUND

Switching units for electrical switching devices and such electrical switching devices are known in principle. They generally have a switching lock with a switching mechanism and a rotor housing. The switching mechanism is connected in the known manner to the rotor housing, such that a contact arm disposed therein can open and close contacts during the rotation of the rotor housing about a rotation axis. The switching mechanism here is generally in a mechanically transmitting arrangement in relation to the rotor housing by way of a lever kinematic, for example a toggle lever.

Known switching units have the problem that such a lever kinematic, in particular a toggle lever, has to be fastened in a secure and mechanically stable manner to the rotor housing. With known switching units fastening is generally achieved by way of a through-shaft or a through-pin, which is supported on both sides in the rotor housing. In known switching units such a connecting pin extends in a transverse manner through the rotor housing, so that conflict can result in the interior between said connecting pin and the contact arms. This means that in known switching units the rotor housing must be embodied as sufficiently large to provide enough space for the penetration of such a connecting pin.

A further disadvantage of known switching units is that the penetration of the connecting pin means that the connecting pin has to be electrically insulated. Electrical insulation, which can already be provided by the rotor housing, is bridged because of the penetrating connecting pin, so that complex and expensive separate electrical insulation of the connecting pin is required. Also this produces a tolerance chain, so that when such connecting pins, a corresponding rotor housing and the lever apparatus are manufactured, particularly small tolerances ranges have to be complied with. This increases costs further when manufacturing known switching units.

SUMMARY

At least one embodiment of the present invention attempts to eliminate at least one of the disadvantages of known switching units as described above in electrical switching devices and known electrical switching devices at least to some degree. In particular, at least one embodiment of the present invention provides a switching unit for an electrical switching device and such an electrical switching device, which allow a more compact structure to be achieved economically and simply at reduced cost.

Further features and details of the invention will emerge from the subclaims, the description and the drawings. Features and details described in the context of at least one embodiment of the inventive switching unit naturally also apply in the context of at least one embodiment of the inventive electrical switching device and vice versa, so that reference is or can be made reciprocally to the individual aspects of at least one embodiment of the invention in respect of the disclosure.

At least one embodiment of an inventive switching unit can be used for an electrical switching device, in particular an electrical circuit breaker. The switching unit has a switching lock with a switching mechanism and a rotor housing. Disposed within the rotor housing is a contact arm. As the rotor housing rotates about a rotation axis, the contact arm is used to open and close contacts. The contacts can also be differentiated as a moving contact and a fixed contact. In other words the switching mechanism is used to rotate the rotor housing about the rotation axis, thereby bringing about the opening and closing of the contacts by way of the contact arm by way of the switching mechanism. For this purpose the switching mechanism can have a switch or grip for example, which is supported in such a manner that it can be moved between at least two positions, in other words at least one on position and one off position.

BRIEF DESCRIPTION OF THE DRAWINGS

The present invention is described in more detail with reference to the accompanying figures. The terms "left" and "right" used here relate to an alignment of the figures with normally legible reference characters. In the schematic drawings.

In the figures below identical reference characters are used for elements of identical action and identical mode of operation.

DETAILED DESCRIPTION OF THE EXAMPLE EMBODIMENTS

Figure 1:
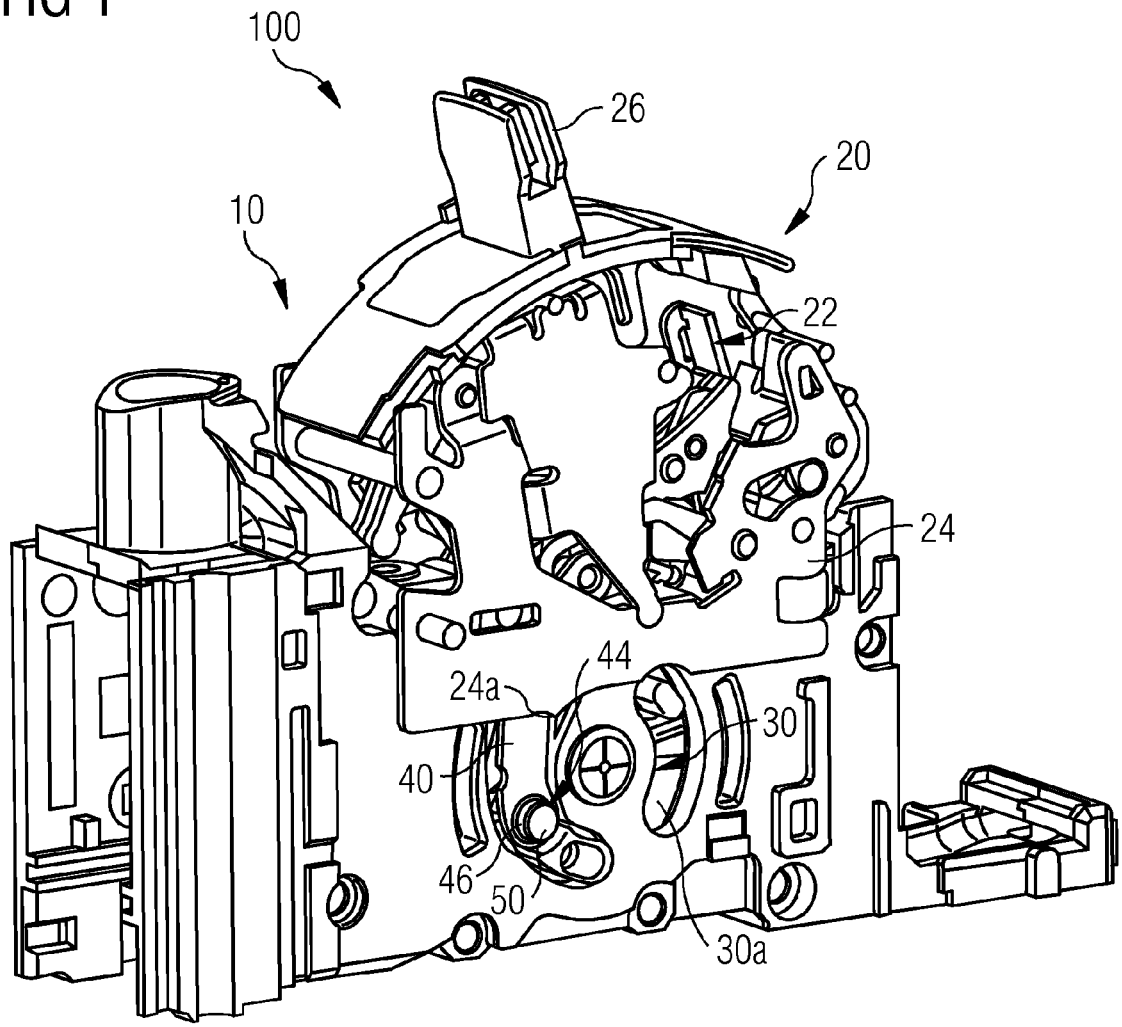
FIG. 1 shows a perspective view of a first embodiment of an inventive electrical switching device.

The present invention will be further described in detail in conjunction with the accompanying drawings and embodiments. It should be understood that the particular embodiments described herein are only used to illustrate the present invention but not to limit the present invention.

Accordingly, while example embodiments of the invention are capable of various modifications and alternative forms, embodiments thereof are shown by way of example in the drawings and will herein be described in detail. It should be understood, however, that there is no intent to limit example embodiments of the present invention to the particular forms disclosed. On the contrary, example embodiments are to cover all modifications, equivalents, and alternatives falling within the scope of the invention. Like numbers refer to like elements throughout the description of the figures.

Specific structural and functional details disclosed herein are merely representative for purposes of describing example embodiments of the present invention. This invention may, however, be embodied in many alternate forms and should not be construed as limited to only the embodiments set forth herein.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items.

It will be understood that when an element is referred to as being "connected," or "coupled," to another element, it can be directly connected or coupled to the other element or intervening elements may be present. In contrast, when an element is referred to as being "directly connected," or "directly coupled," to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" and "at least one of" include any and all combinations of one or more of the associated listed items. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art and will not be interpreted in an idealized or overly formal sense unless expressly so defined herein.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

To allow transmission of the mechanical switching information from the switching mechanism to the rotor housing, at least one lever apparatus is provided in at least one embodiment of an inventive switching unit. This at least one lever apparatus is functionally connected at its upper end to the switching mechanism. At its lower end it is also functionally connected by way of a connecting pin to a face of the rotor housing. A functional connection in the context of at least one embodiment of the present invention in particular refers to a force-transmitting connection. This can be configured to be reversible or non-reversible, so that subsequent disassembly in particular is also possible. The functional connection serves to transmit forces or movement from the switching mechanism to the rotor housing. The movement of individual components of the switching mechanism, in particular of a grip, can thus bring about movement of the contact arm due to rotation of the rotor housing about the rotation axis. The lever apparatus is for example a toggle lever, which is configured in a mechanically rigid manner.

At least one embodiment of an inventive switching unit can be used for an electrical switching device, in particular an electrical circuit breaker. The switching unit has a switching lock with a switching mechanism and a rotor housing. Disposed within the rotor housing is a contact arm. As the rotor housing rotates about a rotation axis, the contact arm is used to open and close contacts. The contacts can also be differentiated as a moving contact and a fixed contact. In other words the switching mechanism is used to rotate the rotor housing about the rotation axis, thereby bringing about the opening and closing of the contacts by way of the contact arm by way of the switching mechanism. For this purpose the switching mechanism can have a switch or grip for example, which is supported in such a manner that it can be moved between at least two positions, in other words at least one on position and one off position.

At least one embodiment of the inventive configuration of the connecting pin allows the functional connection between the lever apparatus and the rotor housing to be effected in a decentralized manner just on one face of the rotor housing. In contrast to known switching units therefore the interior of the rotor housing remains free of a penetrating connecting pin configuration. This free space can be used for example so that the contact arm can be designed to be correspondingly bigger. Alternatively or additionally it is also possible for the rotor housing and therefore the switching unit as a whole to be reduced in respect of the necessary geometric extension. This means that an inventive switching unit is more compact.

The lack of a penetrating connecting pin also means that the electrical insulation of the rotor housings is much simpler. It is sufficient for the rotor housing to be configured for example from electrically insulating material, in particular a plastic material. The fact that the connecting pin is only disposed on one face of the rotor housing and does not penetrate through its interior means that there is no need for additional insulation for the connecting pin. The connecting pin here can be made of metal for example.

The connecting pin can also act as a coupling point for the lever apparatus. This coupling can again be embodied as reversible or non-reversible. The connecting pin for a present invention can be configured as a separate component or as an integral part of an adjacent component. This will be looked at in more detail below.

The rotor housing can also be configured as an encapsulated pole insert. Such a rotor housing can thus be embodied in one or more parts, to accommodate the opening and closing mechanism of the contact arm contained therein.

It can be advantageous if the connecting pin in at least one embodiment of an inventive switching unit is configured as a separate component from the lever apparatus and the rotor housing. Such a separate component is advantageous in particular in respect of the flexibility of use of at least one embodiment of an inventive switching unit.

It is thus possible, depending on the desired situation of use of the switching unit, by exchanging or using connecting pins of different lengths, to adapt the switching unit to the respective integration situation in a flexible manner. The connecting pins can also have different materials or even different thicknesses, so that different mechanical load situations can also be accommodated. A switching unit can then also be used in a flexible manner in different electrical switching devices, in particular with different pole numbers. Such switching units are therefore frequently used in electrical switching devices with at least two poles. Electrical switching devices with three or four poles are of course also conceivable, so that a switching unit can be used to switch not just one rotor housing but a number of adjacent rotor housings for different poles.

It is also advantageous, if in at least one embodiment of an inventive switching unit a pin holder is disposed on at least one face of the rotor housing, the pin holder being configured to accommodate the connecting pin. This is particularly advantageous in embodiments with a separate connecting pin. The pin holder can have connecting device for example. These are in particular threads or other connecting device, as can be provided for example by a splint for securing the connecting pin axially within such a holder. Press fit systems or other fitting systems can also be used for such a pin holder. Form fit devices are naturally also conceivable, so that total incorporation of such a connecting pin can be achieved, for example during an injection molding procedure for the plastic material of the rotor housing. According to at least one embodiment of the invention the flexibility of the switching unit is thus associated with more economical and simpler manufacturing technology.

A further advantage can be achieved in that in at least one embodiment of an inventive switching unit the lever apparatus can have a passage at its lower end. This passage is configured to accommodate the connecting pin. A passage can also refer to an offset segment of the lever apparatus. The lever apparatus can thus be configured for example as essentially flat, in particular plate-like. Instead of a simple hole, an offset region, which is configured to accommodate the connecting pin, can be produced by partial drawing during the pulling-through process. This passage offers so to speak a peripheral surface, in particular in the manner of a cylinder jacket, which provides an adequate bearing surface for the connecting pin to produce the functional connection. The passage can also be configured for example as a thread, a snap lock element or for a press fit in respect of axial securing of the connecting pin. Relative rotations between such a passage of the lever apparatus on the one hand and the connecting pin on the other hand can of course also be advantageous.

The connecting pin preferably extends along an axis, which is disposed parallel or essentially parallel to the rotation axis of the rotor housing. This means that by avoiding or essentially completely avoiding angular displacement between the axis of the connecting pin and the rotation axis, jamming or torque induction is prevented for the lever apparatus during lever kinematic movement.

At least one embodiment of an inventive switching unit can be developed so that the connecting pin extends along a pin axis, which is disposed at a distance from the rotation axis of the rotor housing. This excludes in particular a coaxial arrangement of the axis of the connecting pin and the rotation axis of the rotor housing. The connecting pin is in particular disposed in a decentralized manner in relation to the rotation axis of the rotor housing. Such an embodiment can have advantages, in particular in the form of a toggle lever, which has an essentially flat extension.

It is further advantageous, if in at least one embodiment of an inventive switching unit on both faces of the rotor housing a lever apparatus is functionally connected at its upper end by way of the switching mechanism and at its lower end by way of a connecting pin respectively to a face of the rotor housing. In other words there are lever apparatuses on both faces of the rotor housing, so that in total at least two lever apparatuses are provided. These are preferably distributed symmetrically around the rotor housing. In particular they bring about symmetrical bracing of the individual lever apparatuses or symmetrical force transmission between the switching mechanism and the rotor housing. This improves the force transmission, as in particular torque perpendicular to the rotation axis onto the rotor housing can be reduced or avoided with such force transmission. It also increases the possibilities for varying the use of an inventive switching unit, as further poles in the form of further rotor housings can be coupled directly to both faces in a preferably identical manner.

Coupling can preferably take place in a similarly inventive manner by way of a corresponding connecting pin to the adjacent rotor housing. A further rotor housing can thus be coupled in particular to the left and right respectively of an inventive switching unit, so that a total of three poles can be switched by an individual switching mechanism. When three-phase current is used in at least one embodiment of an inventive switching unit, said three poles can preferably be assigned to three phases.

It is further advantageous if in at least one embodiment of an inventive switching unit the lever apparatus and/or the connecting pin has/have at least one stop surface. This stop surface is configured to limit the rotation of the rotor housing about the rotation axis at least in one direction by coming up against the switching lock. It comes up against the switching lock in particular at a switching lock board of the switching lock. This switching lock board preferably has an essentially flat extension, in particular in the form of a metal plate. It comes up against it so that rotation can be limited by the stop surface. The stop surface can be configured partially at the connecting pin and/or partially at the lever apparatus. In the case of an embodiment of a lever apparatus with a passage in particular the outer surface of such a passage, which is likewise preferably configured in the manner of a cylinder jacket, can have such a stop surface. An opposing stop surface is correspondingly provided on the switching lock, in particular on the switching lock board, being able to engage or make contact in the inventive manner with the stop surface of the lever apparatus and/or of the connecting pin. This can also be referred to as a rotation stop. Torque and/or forces are also preferably absorbed in the stop, so that the load on the rotation axis of the rotor housing is reduced. This allows shorter tolerance chains and also reduces mechanical strain. In particular the stop is disposed on both faces of the switching lock, in other words in particular on two essentially parallel switching lock boards.

At least one embodiment of an inventive switching unit can also be developed so that the connecting pin is configured in an integral, in particular monolithic manner, with the rotor housing or with the lever apparatus. This reduces complexity, so that costs can be reduced in particular in respect of manufacturing outlay. Such a connecting pin can therefore also be made of plastic for example in the same injection molding procedure as the rotor housing.

A further subject matter of at least one embodiment of the present invention is an electrical switching device, in particular an electrical circuit breaker, having at least one inventive switching unit of at least one embodiment. An inventive electrical switching device at least one embodiment of therefore has the same advantages as have been examined in detail in relation to an inventive switching unit of at least one embodiment.

Provision can also be made with at least one embodiment of the inventive electrical switching device for the electrical switching device to be a circuit breaker, in particular a molded case circuit breaker. A circuit breaker here is an electromagnetic automatic switch. It is often also used as a line protection switch, in other words as an overcurrent protection facility in an electrical installation. A molded case circuit breaker in particular is often used at low voltages.

It is also possible to use the electrical switching device as a motor protection switch. An embodiment of the inventive electrical switching device as a circuit breaker, in particular as a molded case circuit breaker, therefore allows the inventive electrical switching device to be used for a plurality of applications.

FIG. 1 shows a first embodiment of an inventive electrical switching device 100. It features an embodiment of an inventive switching unit 10. The inventive switching unit 10 can be embodied for example as shown in FIGS. 2, 3 and 4.

The switching unit 10 is equipped with a switching lock 20. The switching lock 20 in turn has a switching mechanism 22, which can pass on force during movement of the switching lock 20. In order to be able to move the switching lock 20, a switching lever 26 is provided, which is supported by way of the switching lock 22 in such a manner that it can be moved between at least two positions. A switching lock board 24 or a switching lock board 24 on both sides respectively is present, between which the switching mechanism 22 is disposed. Also present below the switching lock 20 in such a switching unit is a rotor housing 30. The rotor housing 30 has two faces 30*a* and 30*b*, the face 30*a* being shown in FIG. 1. A lever apparatus 40 is also disposed between the switching mechanism 22 of the switching lock 20 and the rotor housing 30, being connected functionally at its upper end 42 to the switching mechanism and being connected functionally at its lower end 44 to the rotor housing 30. The lower end 44 here is connected to the rotor housing 30 by way of a connecting pin 50 for the functional connection. This is explained further with reference to FIGS. 2 and 3.

Figure 2:
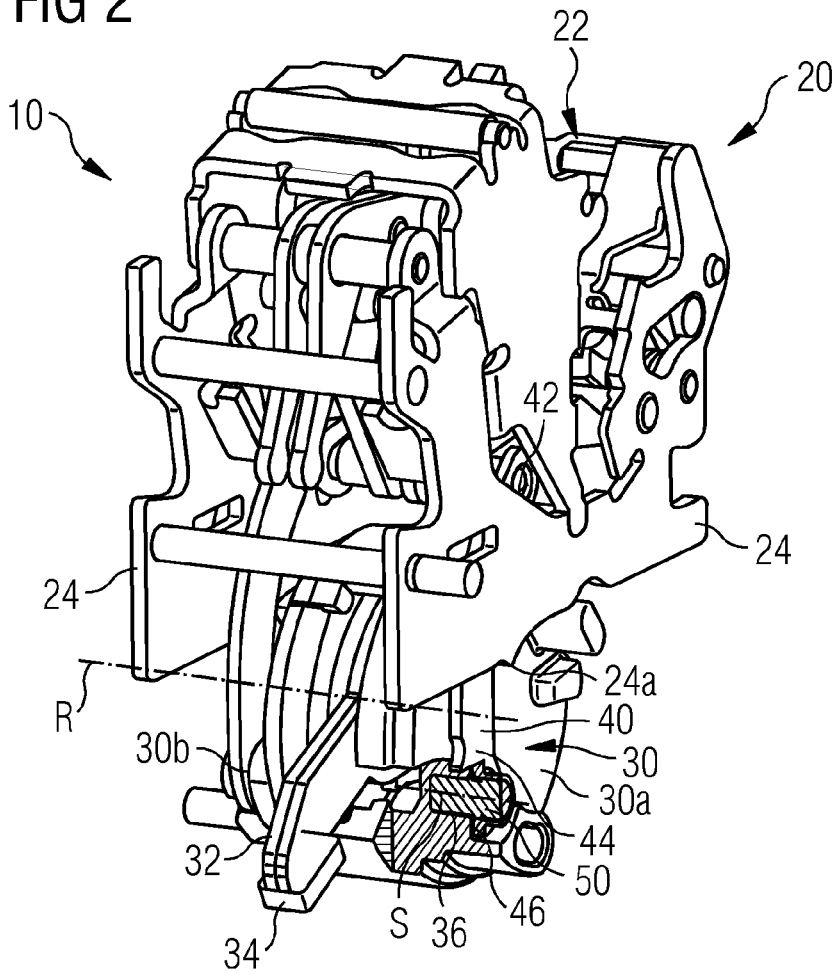
FIG. 2 shows a first embodiment of an inventive switching unit.

FIG. 2 shows a schematic diagram of a switching unit 10 of one embodiment. FIG. 3 shows a detailed view of the functional connection between the lower end 44 of the lever apparatus 40 and the rotor housing 30 by way of the connecting pin 50.

Figure 3:
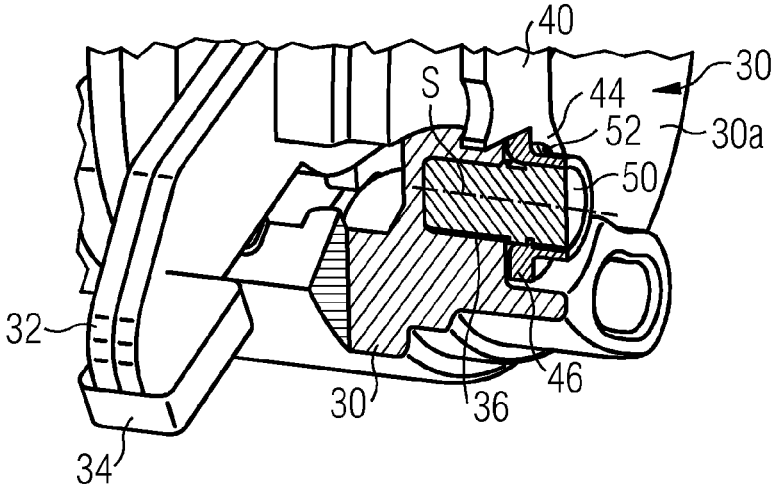
FIG. 3 shows a detailed view of FIG. 2.
Figure 4:
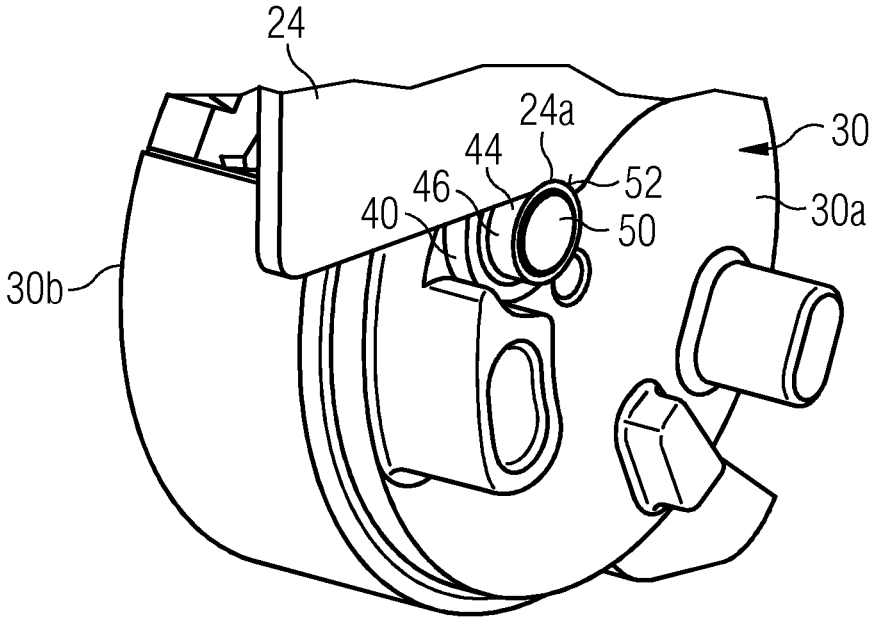
FIG. 4 shows a detailed view of FIG. 2 with the rotation housing in the stop situation.

As shown clearly in FIG. 3, a connecting pin 50 is present as a separate component in a pin holder 36 in the rotor housing 30. The pin holder can be equipped with a thread for example. A passage 46 is also provided at the lower end 44 of the lever apparatus 40, being also designed to accommodate the connecting pin 50. The lever apparatus 40 can therefore be connected functionally to the rotor housing 30 in a force transmitting manner by inserting the pin. The connecting pin 50 extends along a pin axis S. The rotor housing 30 also has a rotation axis R, as illustrated for example in FIG. 2. These two axes R and S are disposed offset from one another but in a parallel manner in relation to one another. The decentralized arrangement means that when the switching lock 20 is moved by way of the switching lever 26, this movement can be converted by way of the lever apparatus 40 to a rotation of the rotor housing 30 about the rotation axis R.

FIG. 4 shows a stop situation, which defines an end position of the rotor housing 30 during rotation about the rotation axis R. This can be in particular an off position, in which contacts 34 of the contact arm 32 do not engage with a fixed contact. A stop surface 52 is provided on the rotor housing 30 or on the connecting pin 50 for this purpose, coming up against the stop 24*a* of the respective lock board 24. This allows a defined end position or rotation position to be provided, in particular for the off position of the switching lock kinematic, due to the geometric correlation of the stop 24*a* and the stop surface 52.

The above descriptions of the embodiments only describe the present invention in the context of examples. Individual features of the embodiments can of course be combined freely with one another, in so far as this is technically expedient, without departing from the scope of the present invention.

The example embodiment or each example embodiment should not be understood as a restriction of the invention. Rather, numerous variations and modifications are possible in the context of the present disclosure, in particular those variants and combinations which can be inferred by the person skilled in the art with regard to achieving the object for example by combination or modification of individual features or elements or method steps that are described in connection with the general or specific part of the description and are contained in the claims and/or the drawings, and, by way of combinable features, lead to a new subject matter or to new method steps or sequences of method steps, including insofar as they concern production, testing and operating methods.

References back that are used in dependent claims indicate the further embodiment of the subject matter of the main claim by way of the features of the respective dependent claim; they should not be understood as dispensing with obtaining independent protection of the subject matter for the combinations of features in the referred-back dependent claims.

Furthermore, with regard to interpreting the claims, where a feature is concretized in more specific detail in a subordinate claim, it should be assumed that such a restriction is not present in the respective preceding claims.

Since the subject matter of the dependent claims in relation to the prior art on the priority date may form separate and independent inventions, the applicant reserves the right to make them the subject matter of independent claims or divisional declarations. They may furthermore also contain independent inventions which have a configuration that is independent of the subject matters of the preceding dependent claims.

Further, elements and/or features of different example embodiments may be combined with each other and/or substituted for each other within the scope of this disclosure and appended claims.

Still further, any one of the above-described and other example features of the present invention may be embodied in the form of an apparatus, method, system, computer program, tangible computer readable medium and tangible computer program product. For example, of the aforementioned methods may be embodied in the form of a system or device, including, but not limited to, any of the structure for performing the methodology illustrated in the drawings.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

LIST OF REFERENCE CHARACTERS

10 Switching unit
20 Switching lock
22 Switching mechanism
24 Switching lock board
24*a* Stop
26 Switching lever
30 Rotor housing
30*a* Face of rotor housing
30*b* Face of rotor housing
32 Contact arm
34 Contact
36 Pin holder
40 Lever apparatus
42 Upper end
44 Lower end
46 Passage
50 Connecting pin
52 Stop surface
100 Switching apparatus
R Rotation axis
S Pin axis

What is claimed is:

1. A switching unit for an electrical switching device, comprising:

a switching lock including a switching lock board, a switching mechanism and a rotor housing, the rotor housing including a contact arm disposed therein for opening and closing contacts during a rotation of the rotor housing about a rotation axis, the switching lock board being stationary during the rotation of the rotor housing; and at least one lever apparatus, functionally connected at an upper end to the switching mechanism and functionally connected at a lower end by way of a connecting pin to a face of the rotor housing such that the at least one lever apparatus extends from the lower end to the upper end in a space that is between the switching lock board and the rotor housing, wherein at least one of the lower end of the at least one lever apparatus and the connecting pin includes at least one stop surface, configured to limit rotation of the rotor housing about the rotation axis at least in one direction by coming up against a stop of the switching lock board.

2. The switching unit of claim 1, wherein the connecting pin is configured as a separate component from the at least one lever apparatus and the rotor housing.

3. The switching unit of claim 2, wherein a pin holder is disposed on at least one face of the rotor housing, the pin holder being configured to accommodate the connecting pin.

4. The switching unit of claim 3, wherein the at least one lever apparatus includes a passage at the lower end, configured to accommodate the connecting pin.

5. The switching unit of claim 2, wherein the at least one lever apparatus includes a passage at the lower end, configured to accommodate the connecting pin.

6. The switching unit of claim 1, wherein the connecting pin extends at least in segments along a pin axis, disposed parallel or essentially parallel to the rotation axis of the rotor housing.

7. The switching unit of claim 1, wherein the connecting pin extends along a pin axis, disposed at a distance from the rotation axis of the rotor housing.

8. The switching unit of claim 1, wherein the at least one lever apparatus includes two lever apparatuses, and wherein on each face of the rotor housing, one of the two lever apparatuses is respectively functionally connected, at an upper end by way of the switching mechanism and at a lower end by way of a connecting pin, to a face of the rotor housing.

9. The switching unit of claim 1, wherein the connecting pin is configured in an integral manner with the rotor housing or with the at least one lever apparatus.

10. An electrical switching device, comprising at least one switching unit of claim 1.

11. The electrical switching device of claim 10, wherein the electrical switching device is a circuit breaker.

12. The switching unit of claim 1, wherein the switching unit is for a circuit breaker.

13. The switching unit of claim 1, wherein the switching lock board includes two parallel plates, between which the switching mechanism is arranged, and the stop includes two stop portions at same positions on each of the two parallel plates.

14. The switching unit of claim 1, wherein the stop is a recessed portion of the switching lock board.

15. A switching unit for an electrical switching device, comprising:

a switching lock including a switching lock board, a switching mechanism and a rotor housing, the rotor housing including a contact arm disposed therein for opening and closing contacts during a rotation of the rotor housing about a rotation axis, the switching lock board being stationary during rotation of the rotor housing; and at least one lever apparatus, functionally connected at an upper end to the switching mechanism and functionally connected at a lower end by way of a connecting pin to a face of the rotor housing such that the at least one lever apparatus extends from the lower end to the upper end in a space that is between the switching lock board and the rotor housing, wherein a pin holder is disposed on the face of the rotor housing, the pin holder being configured to accommodate the connecting pin such that the connecting pin does not penetrate an inner wall of the rotor housing.

16. The switching unit of claim 15, wherein at least one of the lower end of the at least one lever apparatus and the connecting pin includes at least one stop surface, configured to limit rotation of the rotor housing about the rotation axis at least in one direction by coming up against a stop of the switching lock board.

* * * * *